United States Patent [19]

Dunn, Jr. et al.

[11] Patent Number: 4,531,739

[45] Date of Patent: Jul. 30, 1985

[54] BUMPER FOR OUTDOOR BUMPER POOL TABLE

[76] Inventors: Edward G. Dunn, Jr., 136 E. 50th St., Indianapolis, Ind. 46205; Edward G. Dunn, Sr., 7701 Spring Mill Rd., Indianapolis, Ind. 46260

[21] Appl. No.: 611,469

[22] Filed: May 17, 1984

[51] Int. Cl.[3] ..... A63F 7/12

[52] U.S. Cl. ..... 273/127 C; 403/407; 273/123 R

[58] Field of Search ..... 273/127 R, 127 C, 127 B, 273/119 A, 118 A, 120 A, 121 A, 125 R, 122 A, 123 A, 124 A, 125 A, 129 P, 129 S, 118 R, 119 R, 123 R, 121 R, 6, 14; 24/214, 216, 217 R, 213 R; 200/61.11, 61.1; 5/86 A; 403/406, 407, 408; 16/86 R, 86 A

[56] References Cited

U.S. PATENT DOCUMENTS

| | | | |
|---|---|---|---|
| 828,211 | 8/1906 | Johnson | 273/123 R |
| 2,596,780 | 3/1952 | Myers et al. | 5/86 A |
| 2,760,224 | 8/1956 | Hennelly | 5/86 A |
| 3,958,804 | 5/1976 | Godfrey | 273/123 R |
| 4,240,634 | 12/1980 | Wiczer | 273/127 R |
| 4,423,872 | 1/1984 | Okada | 273/121 A |
| 4,460,176 | 7/1984 | Peters | 273/127 C |

FOREIGN PATENT DOCUMENTS

| | | | |
|---|---|---|---|
| 769402 | 8/1934 | France | 273/123 R |

*Primary Examiner*—Richard C. Pinkham

*Assistant Examiner*—T. Brown

*Attorney, Agent, or Firm*—Woodard, Weikart, Emhardt & Naughton

[57] ABSTRACT

A bumper for use as part of an outdoor bumper pool table includes a center support hub which is adapted to be attached to the top playing surface of the pool table. The support hub includes an upper cushion of silicone rubber which is compatibly sized and contoured so as to snap over the upper lip portion of the support hub. In order to cushion the rebounding action of pool balls as they strike the bumper, the support hub retains in a snap-fit configuration a lower cushion of silicone rubber which acts as a cushioning pad between the support hub and the top of the playing surface. A threaded rod, which is securely anchored as part of the center support hub, in combination with a flat washer and wing nut provide the fastening method of the support hub to the playing surface. A hub adjustment member of silicone rubber is disposed between the lower cushion and the wing nut. This hub adjustment member is cylindrical and shouldered wherein its smaller diameter portion extends through the playing surface and its larger-diameter portion abuts against the underside of the playing surface. The wing nut and flat washer abut against the larger-diameter portion and as they are tightened, they draw the bumper against the top playing surface. This tightening action results in axial compression of the hub adjustment member thereby allowing the rigidity of the bumper and the pace of the game to be controlled.

7 Claims, 5 Drawing Figures

BUMPER FOR OUTDOOR BUMPER POOL TABLE

BACKGROUND OF THE INVENTION

The present invention relates in general to pool tables and to bumper pool tables which are uniquely adapted to be portable and usable outdoors. More particularly, the present invention relates to essential parts of such tables.

Conventional pool tables typically include a slate, concrete, or honeycomb bed covered with felt and the frame is constructed of wood, metal, fiberglass, or a combination of these materials. While the weight of the pool table is important to the overall stability, the construction of the frame is critical for the support of the slate bed and for stabilizing this slate bed in order to provide a true and level top playing surface. While current-day "felt" is frequently a blended synthetic fiber, it may still be adversely affected by wear, contact with debris and moisture. By all normal concepts and interpretations, these conventional pool tables are never used outdoors nor intended for such use because of their size and weight and because of their susceptibility to environmental conditions such as rain and snow. Pool tables which have been designed for use outdoors have been of sturdy and heavy construction employing concrete slabs. These tables are heavy and nonportable and some use liquid support and leveling means for the heavy concrete surfaces. Furthermore, they are not of a knockdown type wherein the table is easily assembled or disassembled for moving or storage.

An alternative pool table concept which has found certain acceptance due to its smaller size, lighter weight and lower cost is a bumper pool table. These types of pool tables are considerably smaller and lighter in weight than conventional, regulation pool tables and provide a different game format and different game rules. Bumper pool tables typically have an octagonal-shaped top playing surface, a base and a series of raised bumpers which play an active part in the actual game. While such bumper pool tables are generally smaller than conventional pool tables, they are still not suitable for outdoor use because of their weight, and because they are neither designed nor constructed to withstand an outdoor environment. These tables also are not of knockdown construction and are therefore not easily assembled and disassembled into component parts which can be easily moved or stored.

While pool tables and bumper pool tables alike provide an excellent form of recreation, their use is limited to indoors and usually in a fixed location and thus they are typically not used during good weather nor during such occasions as swimming and lawn parties and cookouts. Furthermore, outdoor pool tables have not been portable and can only be used in one location and are not easily disassembled and moved to another location or stored out of the way when use is not desired.

If a portable pool table or a portable knockdown bumper pool table, could be designed and constructed to be used outdoors, it would provide an excellent form of recreation for the above types of gatherings which is not now available. The limited space requirements for playing bumper pool provides a strong incentive for designing a bumper pool table which is both portable and suitably constructed for use outdoors. However, there are certain design constraints envisioned for such a product including the fact that the unit must be waterproof, portable, able to be leveled and able to tell when the playing surface is level, means to secure the table to prevent theft and storage space for the cues and balls. Further, the portable table would have to have means for increasing its weight for proper stability and nonportability when it is in use and means for decreasing its weight and portability when it is moved from outdoors to indoors. One such suitable portable, outdoor pool table is disclosed in our prior, co-pending patent application Ser. No. 462,626, filed Jan. 31, 1983.

While portability is one aspect of outdoor use, the proper selection of materials is believed to be equally important, if not more important. In the event a user elects not to move the table, such as indoors, its ability to withstand a variety of weather conditions becomes critical. While weather resistant materials exist, the selection of a suitable material must take into consideration assembly of those materials and whether or not their use will have an effect on the game. For example, if certain materials are selected, their elasticity and resiliency must be ascertained and their effect on the ball action assessed. It is important that if there is a particular rebounding effect of balls off of bumper pool table bumpers, that the same effect be maintained over a range of temperatures.

The present invention discloses on component part of a pool table construction wherein the selection and use of materials is made so that the table will be suitable for prolonged outdoor use while not sacrificing the durability of construction and reproducibility of game effects and responses.

The following patents may have some relevance to the present invention, but they do not anticipate or render the present invention obvious:

| U.S. Pat. No. | Inventor | Title |
|---|---|---|
| 3,941,378 | Bagley | Convertible Pool Dining Table with Retractable Ball Box |
| 3,837,645 | Criswell | Playing Table with Base for Molding Fluid Therein |
| 3,658,328 | Kooker | Pool game tables and components for use therein |

The Bagley patent discloses an indoor dining room table/bumper pool table. This table is intended to convert from a dining room table to a bumper pool table. Criswell discloses an outdoor regulation pool table which uses a concrete slab for the playing surface. The concrete slab's weight is supported by and leveled by liquid contained in the multi-pedestal support arrangement which is disposed beneath the concrete slab. Criswell provides a sturdy and solid outdoor table which would resist the weather and the wear and tear of outdoor use. The table is set up in a fixed location and is not portable or of a knockdown construction. While not a bumper pool game, Kooker discloses a single pedestal pool game structure and components made by casting concrete. Kooker provides for ball return passageways that are formed during the casting which collect the balls in a central location and then deliver them to a collection tray extending from the pedestal. The table is not intended to be of a knockdown and portable nature because it is cast of concrete and shown embedded in the ground. Further, Kooker's leveling means rest above the unsecured pedestal cap and the pedestal and the top portion is supported in a direct line with the pedestal.

Since none of the foregoing references adequately address the concept of an outdoor, portable pool table, it is not surprising that they are each silent as to the need to accurately select specific materials and how to incorporate those specific materials into the pool table structure.

SUMMARY OF THE INVENTION

An outdoor bumper pool table according to one embodiment of the present invention comprises a center support hub suitably designed and styled to be assembled to the top playing surface of the outdoor bumper pool table, an upper cushion member disposed on the center support hub, a lower cushion disposed on the center support hub, fastener means, including a tightening member disposed adjacent the underside of the top playing surface, for securely attaching the center support hub to the top playing surface, and a hub adjustment member resiliently compressible in an axial direction and disposed between the lower cushion and the tightening member the degree of tightening of said tightening member controlling the axial compression of the hub adjustment member which in turn controls the rigidity of the attachment of the center support hub relative to the playing surface.

DESCRIPTION OF THE PREFERRED EMBODIMENT

Figure 1:
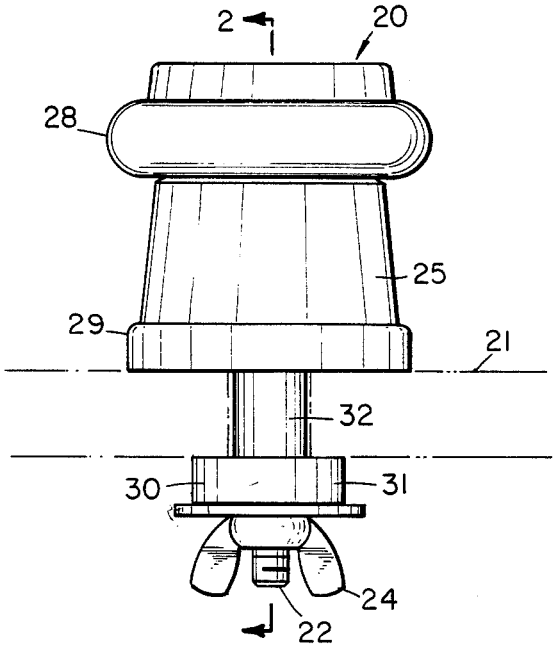
FIG. 1 a front elevation view of a bumper for use as part of an outdoor bumper pool table according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a bumper 20 for use as part of an outdoor bumper pool table. As is illustrated, bumper 20 is mounted to the pool table playing surface 21 by means of an externally threaded rod 22, a clamping flat washer 23 and wing nut 24. As will be described hereinafter, the threaded nut 22 is, in the exemplary embodiment, rigidly secured within the center support hub 25 of the bumper. Alternatively, the wing nut, flat washer and threaded rod arrangement could be replaced by similar fasteners such as a hex head bolt. if such a bolt is used, then an internally threaded hole is provided as part of the center support hub in order to securely anchor the bumper to the pool table playing surface.

Cooperating with center support hub 25 in order to create bumper 20 are an upper cushion 28, a lower cushion 29, and a hub adjustment member 30. As is illustrated in greater detail in FIG. 2, the upper cushion 28 snaps over and around the upper portion of center support hub 25 while the lower cushion 29 snaps over and around the lower edge of the center support hub. As will be explained, each of these component parts are specially contoured and shaped so as to easily and reliably snap together into the finished bumper. The hub adjustment member 30 is a stepped (shouldered) cylindrical spacer having a larger base portion 31 and a smaller diameter post portion 32. With threaded rod 22 securely anchored into the center support hub, additional tightening by means of wing nut 24 draws the center support hub downwardly toward playing surface 21. As this occurs, hub adjustment member 30 is axially compressed. Due to the flexible and resilient nature of member 30, the bumper may be secured very rigidly to the table while at the same time permitting some "play" or spring to the bumper relative to the table. This play is desirable in a bumper pool game so that the pool balls striking the bumper will be cushioned to some degree thereby reducing the amount of rebound. Based upon the concept of utilizing this resilient adjustment member, it is possible to very accurately fine tune the desired amount of rebounding spring simply by means of how tightly the center support hub is drawn downwardly and anchored to the playing surface. The tigher the wing nut, the greater the degree of axial compression to member 30 and the faster the game with more rebounding action. Conversely, the looser the wing nut is tightened onto the threaded rod, the slower the gam becomes. Post portion 32 of the hub adjustment member 30 extends through a clearance hole in the playing surface. The base portion, being of a larger diameter than the clearance hole, abuts up against the underside of the top playing surface.

Figure 2:
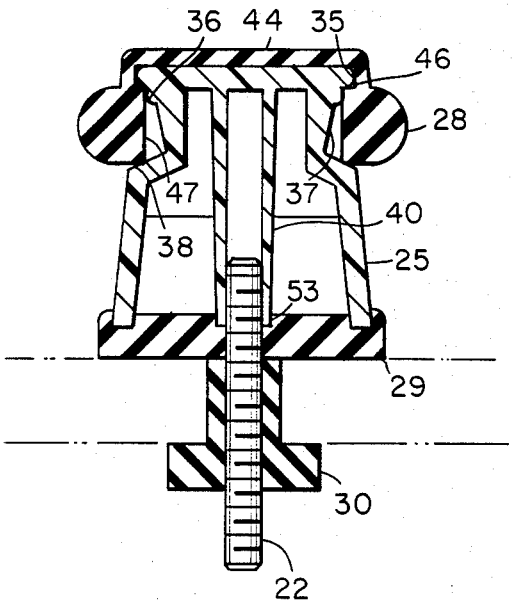
FIG. 2 is a front elevation full section view of the FIG. 1 bumper as taken along line 2—2 in FIG. 1.
Figure 3:
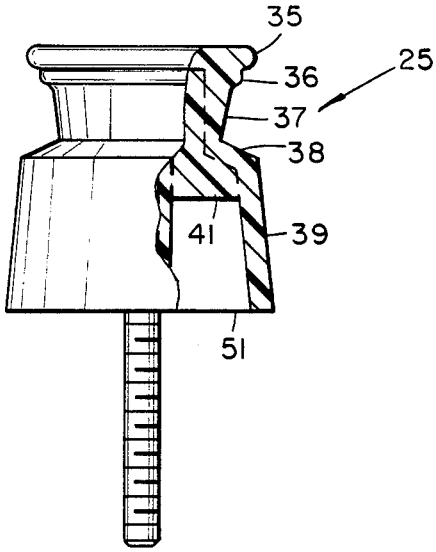
FIG. 3 is a fragmentary, front elevation view of a central support hub comprising a portion of the FIG. 1 bumper.

Referring to FIG. 2, the detailed contour of the various component parts, as assembled, is illustrated. As is shown, and as additionally illustrated in FIG. 3, center support hub 25 includes a top radiused lip 35, a smaller under lip 36, recessed wall 37, beveled edge 38 and outwardly tapered body portion 39. Disposed internally and extending downwardly from the underside of the top lip is a central support boss 40 into which threaded rod 22 is disposed and securely anchored. Spanning the separation between the interior surface of the center support hub and the interior support boss are a series of webs 41, one of which is illustrated in FIG. 3. It is to be understood that there are three such webs disposed about the interior support boss and equally spaced 120° apart. These webs provide the necessary strength and rigidity for the center support hub so that it will suitably withstand the impact of the pool balls, even though only anchored to the pool table playing surface at a single point.

Figure 4:
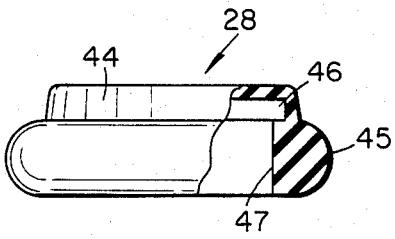
FIG. 4 is a fragmentary, front elevation view of an upper cushion comprising a portion of the FIG. 1 bumper.

Referring to FIG. 4, the upper cushion 28 is illustrated in greater detail. Cushion 28 includes a top cap portion 44 and a full radiused body portion 45 which provides a majority of the bumper resiliency and rebounding action for the pool balls. The top cap portion and body portion are arranged internally relative to one another so as to define an inwardly opening, annular interior channel 46. Base upon the illustration of FIG. 2, it is to be understood that top lip 35 fits comfortably within channel 46 when the upper cushion is flexed and snapped in place over the center support hub. The interior wall 47 of the upper cushion represents an interior cylindrical surface whose diameter dimension is substantially the same as the outside diameter size of recessed wall 37. The axial height of interior wall 47 is likewise substantially the same the height of recessed wall 37 which extends between the underside or under lip 36 and the upper edge of bevelled surface 38. As should be understood, recessed wall 37 has a slight concavity to its exterior surface thereby providing a slight void between its outer surface and the inside diameter surface of interior wall 47. This void allows some reduction in the spring action and rebound of the upper cushion, a characteristic which is important. Since the upper cushion and lower cushion are fabricated from silicone rubber, a requirement for prolonged outdoor use, applying this silicone rubber directly to center support hub 25 would result in too much rebounding action to the impacting pool balls.

Although it is top lip 35 which fits within interior channel 46, it should be understood that underlip 36 serves as a stop against which interior wall 47 abuts thereby assuring the previously mentioned air void due to the fact that the recessed wall 37 has a smaller outside diameter than does underlip 36.

Figure 5:
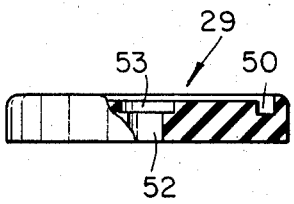
FIG. 5 is a fragmentary, front elevation view of a lower cushion comprising a portion of the FIG. 1 bumper.

Referring to FIG. 5, lower cushion 29 is illustrated in greater detail. Lower cushion 29 includes an outer annular channel 50 which has a radial width substantially the same, although slightly smaller than the wall thickness of the tapered body portion 39 of center support hub 25. In this manner, and in part due to the fact that the lower cushion is also constructed of silicone rubber, this lower cushion will snap in place onto and about bottom edge 51 (see FIG. 3). The flexibility as well as resiliency of the lower cushion allows it to be formed and manipulated so as to easily snap onto and over this bottom edge portion. Once snapped in place, it remains there until pried or peeled off, if such would be necessary for either replacement or repair. The center portion of cushion 29 includes a clearance hole 52 which has a top counterbore 53. This clearance hole 52 is provided for the threaded rod 22 and the counterbore portion is provided for the lower edge of the support boss to fit inside. Receipt of the lower edge of the support boss within this counterbore portion assists in stabilizing the lower cushion and reducing any flexing or twisting or other deflection of the lower cushion, and at the same time provides an abutment surface as part of the overall clamping action as the wing nut is tightened to draw the bumper 20 against playing surface 21. Cushion 29 serves as the mounting pad for the bumper and provides a stable, yet shock-absorbing, interface between the hub and the top playing surface.

Hub adjustment member 30 provides a soft pad which serves as an insulator and shock absorber between the flat washer-wing nut combination and the lower cushion. This member also provides a means to control the pace of the bumper pool game by controlling the amount of spring and rebound action permitted to the pool balls which strike the disclosed bumper. Lower cushion 29 acts as a soft cushioning pad which will be disposed directly against the top surface of the pool table as previously mentioned. The hub adjustment member is disposed in contact with this soft pad (lower cushion) by means of a clearance hole provided in the playing surface through which post portion 32 extends. Advancement of the wing nut on the threaded rod axially compresses the adjustment member as the hub is drawn tight against the playing surface. The greater the degree of compression the more rigid member 30 becomes, thereby increasing the rigidity of the bumper and the action of the balls.

As previously mentioned, this particular bumper, though likely applicable in a number of different applications, not limited simply to pool or bumper pool, is in the exemplary embodiment intended for outdoor use. Consequently, material selection is critical, and once those material selections are made, the mounting and assembly techniques are limited. For example, it is known that silicone rubber is likely the only material suitable for use outdoors over a wide range of temperatures while remaining flexible and resilient over a period of prolonged outdoor use. However, one difficulty with silicone rubber is that it is difficult to assemble it to other objects using conventional techniques. Glue is usually not suitable and consequently when components are made of silicone rubber, they must be utilized and assembled by alternate approaches. This is one reason for the snap-fit approach of the present invention. Both the upper and lower cushion being made of silicone rubber are each configured so as to snap into position on the center support hub. There are no mechanical fasteners used at this location nor any glue or similar attachment techniques. The entire assembly of these two cushion members to the center support hub is done in a manual snap-fit fashion and it is the specific dimensioning and contouring of the various component parts which lends to the suitability of this approach and the suitability of the final assembly for the intended purpose of a bumper for a bumper pool table.

It has been found that the upper cushion should have a durometer of approximately 50 while the lower cushion and the hub adjustment member should have a durometer of approximately 30. The center support hub is constructed of a rigid plastic and as such is suitable for outdoor use. The only components that might be questionable as far as their suitability for outdoor use are the threaded rod, flat washer and wing nut which are of a metallic construction and thus could be susceptible to corrosion. One approach is to use corrosion-resistant or stainless steel fasteners, but even if noncorrosion-resistant materials are used, these components are well protected from the environment due to their placement interior of the center support hub and below the pool table playing surface wherein access to those parts is suitably sealed by the pressure of the lower cushion against the top portion of the playing surface.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A bumper for use as part of an outdoor bumper pool table, said bumper comprising:

a center support hub adapted to be attached to the top playing surface of said outdoor bumper pool table;

an upper cushion disposed on said center support hub;

a lower cushion disposed on said center support hub, said lower cushion adapted to be disposed directly against said top playing surface;

fastener means for securely attaching said center support hub to said top playing surface, said fastener means including a tightening member adapted to be disposed adjacent the underside of said top playing surface; and a hub adjustment member compressible in an axial direction and disposed between said lower cushion and said tightening member, whereby said tightening member controls the axial compression of said hub adjustment member which in turn controls the rigidity of the attachment of said center support hub to said top playing surface.

2. The bumper of claim 1 wherein the center support hub is constructed of a hard plastic material and wherein said fastener means further includes an externally threaded rod rigidly retained as part of said center support hub.

3. The bumper of claim 2 wherein the upper cushion and lower cushion are each constructed of silicone rubber.

4. The bumper of claim 3 wherein said hub adjustment member is constructed of silicone rubber.

5. The bumper of claim 1 wherein said center support hub, said upper cushion and said lower cushion are each cooperatively configured such that the center support hub retains the upper cushion in a snapped-on fashion at its upper end and retains the lower cushion in a snapped-on fashion about its lower end.

6. The bumper of claim 1 wherein said hub adjustment member includes a first diameter portion which extends through the top playing surface and a second, larger-diameter portion which abuts against the underside of said top playing surface.

7. A multi-component bumper for use as part of an outdoor bumper pool table, said bumper comprising:

a center core portion;

a surrounding, resilient cushion snapped in place on said center core portion;

means for anchoring said center core portion to the top playing surface of said bumper pool table, said means for anchoring including a threaded rod securely retained within said center core portion and a tightening member threadedly received by said threaded rod; and a resiliently compressible spacer disposed between said center core portion and said anchoring means and being compressible by said anchoring means whereby the degree of compression of said resiliently compressible spacer relates directly to the rebounding action of a bumper pool ball off of the bumper, said resiliently compressible spacer being a shouldered, generally cylindrical member having a smaller-diameter upper portion which extends through the top playing surface and a lower larger-diameter portion which abuts directly against said tightening member.

* * * * *